United States Patent [19]

Vanderlaan

[11] 4,307,999

[45] Dec. 29, 1981

[54] FREE PISTON ENGINE PUMP INCLUDING VARIABLE ENERGY RATE AND ACCELERATION-DECELERATION CONTROLS

[75] Inventor: Robert D. Vanderlaan, Kalamazoo, Mich.

[73] Assignee: Pneumo Corporation, Boston, Mass.

[21] Appl. No.: 51,510

[22] Filed: Jun. 25, 1979

[51] Int. Cl.[3] ..... F04B 35/02

[52] U.S. Cl. ..... 417/324; 417/364

[58] Field of Search ..... 417/380, 364, 340, 324

[56] References Cited

U.S. PATENT DOCUMENTS

| | | | |
|---|---|---|---|
| 1,294,271 | 2/1919 | Humphrey | 417/364 X |
| 2,423,720 | 7/1947 | Mullejans et al. | 417/364 |
| 2,667,300 | 1/1954 | Huber | 417/364 X |
| 2,914,909 | 12/1959 | Kubik | 417/364 X |
| 2,978,986 | 4/1961 | Carder et al. | 417/340 X |
| 3,606,591 | 9/1971 | Potma | 417/364 |
| 3,995,974 | 12/1976 | Herron | 417/380 |

*Primary Examiner*—Leonard E. Smith

*Attorney, Agent, or Firm*—Maky, Renner, Otto & Boisselle

[57] ABSTRACT

In a free piston engine pump means are provided for obtaining a variable energy rate output and for controlling acceleration and deceleration of the piston masses. In particular a second high output work rate phase is obtained at the end of the power stroke helping to decelerate the piston masses, and a high input work rate phase is provided at the beginning of the return compression stroke to accelerate the piston masses while maintaining the total input energy of the return stroke relatively constant from cycle to cycle and substantially independent of the total output energy of the power stroke.

53 Claims, 27 Drawing Figures

FIG. 3A
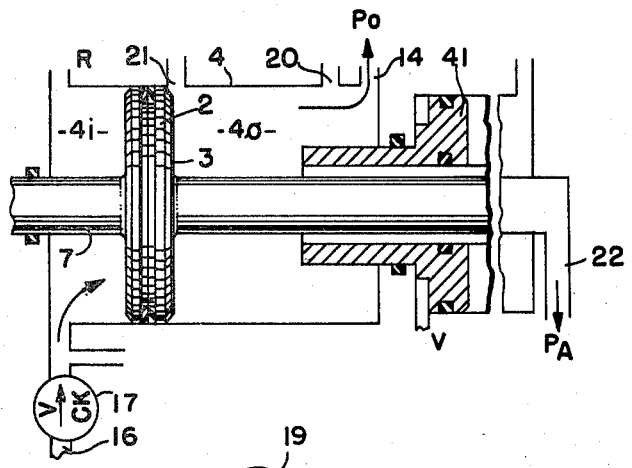
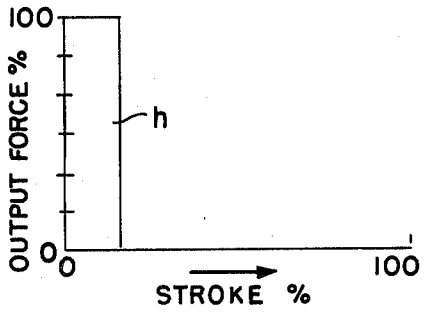
FIG. 3B
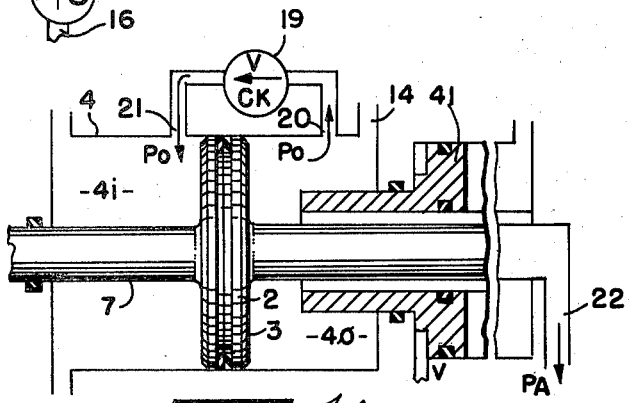
FIG. 4A
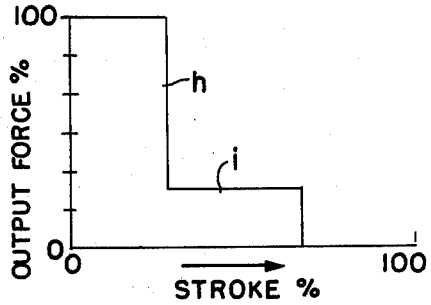
FIG. 4B
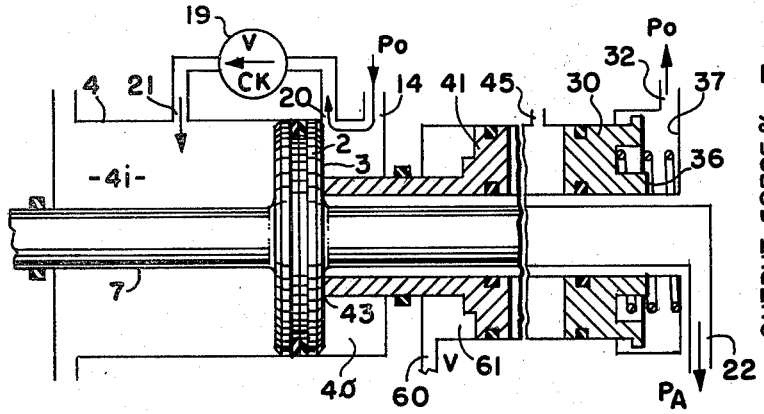
FIG. 5A
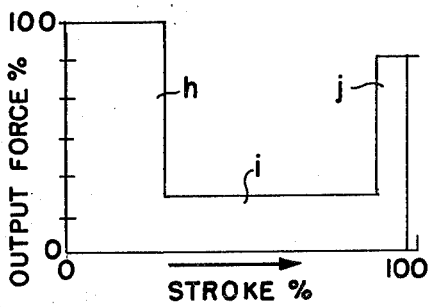
FIG. 5B

FREE PISTON ENGINE PUMP INCLUDING VARIABLE ENERGY RATE AND ACCELERATION-DECELERATION CONTROLS

BACKGROUND OF THE INVENTION

The present invention relates generally to free piston engine pumps and, more particularly, to variable energy rate and acceleration-deceleration controls for free piston engine pumps.

A free piston engine pump differs from the usual piston engine driven pump in that the reciprocating movement of the piston is not first transmitted to a crankshaft to convert linear movement to rotary movement and then back to linear movement by means of a pump swash plate to drive the pump piston. Instead, a direct linear drive connection is provided between the engine piston and pump piston for effecting linear movement thereof. Eliminating the linear-to-rotary crankshaft elements and rotary-to-linear pump swash plate results in a substantial reduction in size and weight of the pump and also greatly improves the efficiency thereof. There are also other corollary and independent advantages of free piston engine pumps, as is well known.

One example of a free piston engine pump is disclosed in commonly assigned copending U.S. Patent Application Ser. No. 842,494, filed Oct. 17, 1977. In the free piston engine pump disclosed therein plural hydraulic piston areas or hydraulic pressures are suitably valved to properly "phase" such areas or pressures during the engine stroke to minimize the inertia-storage of energy required to match the natural variation of energy (work) of the internal combustion cycle to obtain smooth operation. A relatively high energy or work rate phase occurs at the beginning of the power stroke during the gas expansion cycle in the engine which drives the engine piston and, thus, the pump piston. Then, there is at least one intermediate phase, during which the work rate is lower than the initial one, and a relatively high output work rate at the end of the power stroke. The high work rate phase at the end of the power stroke causes rapid deceleration at the end of the stroke and thus effects a higher ratio of average piston speed to peak speed, which tends to reduce cycle time without incurring the efficiency losses that accompany higher piston speeds. Return of the pump piston and the engine piston in a return or compression stroke is accomplished by an input of fluid from the hydraulic reservoir and/or accumulator returning the pistons to initial positions ready for the next power stroke. Preferably during the return stroke non-uniform return stroke energy is provided to the free piston engine pump, with the piston momentum carrying the piston through the latter portion of the return stroke while fluid is supplied to the pump from a reservoir to replenish the pump with fluid prior to the next power stroke.

SUMMARY OF THE INVENTION

In the present invention there is provided improved means for achieving a second high output work rate phase at the end of the power stroke in a free piston engine pump. Moreover, provision is also preferably made for achieving a high input work rate phase at the beginning of the return stroke (hereinafter used interchangeably with "compression stroke").

In order to improve the energy efficiency of the free piston engine pump cycle and to optimize engine performance, the total input energy of the return (compression) stroke should be relatively constant from cycle to cycle and not related to the total output energy of the power stroke. According to one aspect of the present invention a high input work phase, which is usually relatively constant from cycle to cycle, is provided at the beginning of the return stroke for rapid acceleration of the piston masses. Such fast acceleration reduces cycle time resulting in improved efficiency and also permits a faster cycle rate capability than was previously possible. The magnitude and/or duration, i.e. percentage of the return stroke over which such high input work phase occurs at the beginning of the return stroke preferably are automatically controlled or regulated so as to be substantially independent of precisely timed control valve functions.

Briefly, such return stroke operation is accomplished by a secondary pump piston, which is mechanically independent of the primary pump piston. During at least part of the power stroke the primary pump piston drives the secondary piston from its initial position to a maximum or extreme position in the pump, the distance between such two positions being predetermined and ordinarily relatively fixed. At the beginning of the return stroke it is the travel of the secondary piston over this predetermined distance in response to a fluid work input thereto that transmits work to the primary pump piston to accelerate its return. According to another aspect of the invention the above noted secondary piston also facilitates the obtaining of such high output work rate phase at the end of the power stroke.

Also, for structural protection of the free piston engine pump of the invention provision is made for absorbing a relatively large amount of excess energy at the end of the power stroke, for example resulting from the unusual condition of the energy input of the gas expansion cycle being much greater than the output work removed by the hydraulic pump. Additional features of the present invention include a porting arrangement, not only for absorbing such excess energy but also for recovering and retaining at least part of the same as useful output work, and improved cycle rate control and first cycle input work boost techniques.

With the foregoing in mind, it is a primary object of this invention to provide a free piston engine pump that is improved in the noted respects.

Another object is to provide means for controlling the variable energy rate and acceleration-deceleration of a free piston engine pump.

An additional object is to provide a high output work rate phase at the end of the power stroke that is not dependent on precisely timed control valve functions.

A further object is to provide a high input work rate phase at the beginning of the return (compression) stroke.

Still another object is to establish a second high output work rate phase at the end of the power stroke and/or a high input work phase at the start of the return stroke, each being substantially independent of the initial high output work rate phase of the power stroke.

Still an additional object is to eliminate the cycle rate variations between cycles by limiting input work variations during the return stroke by effecting such return stroke independently from the output power stroke work variations.

Still a further object is to facilitate start-up of a free piston engine pump so that the first stroke of input work will be greater than succeeding (operating) input work levels, thus obtaining a high compression pressure and temperature which is advantageous for first cycle combustion.

Another object is to retain as useful hydraulic work small excesses in output work beyond that representing normal operation.

Still another object is to absorb a high level of energy at the end of a power stroke to provide structural protection due, for example, to system malfunction or extreme energy input variations between cycles, and preferably to return such absorbed energy as useful hydraulic work.

A further object is to simplify the cycle valve arrangement of a free piston engine pump to provide precisely repeatable rate control during the power and return strokes without critical valve timing.

These and other objects and advantages of the present invention will become more apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIGS. 3A and 3B through 11A and 11B are fragmentary, schematic illustrations of the pump of FIG. 1 showing the various stages of operation and the output and input work schedules occurring in such operation;

FIG. 16 is a partial schematic illustration of a further alternate free piston engine pump in accordance with the invention.

DESCRIPTION OF THE PREFERRED EMBODIMENTS

Figure 1:
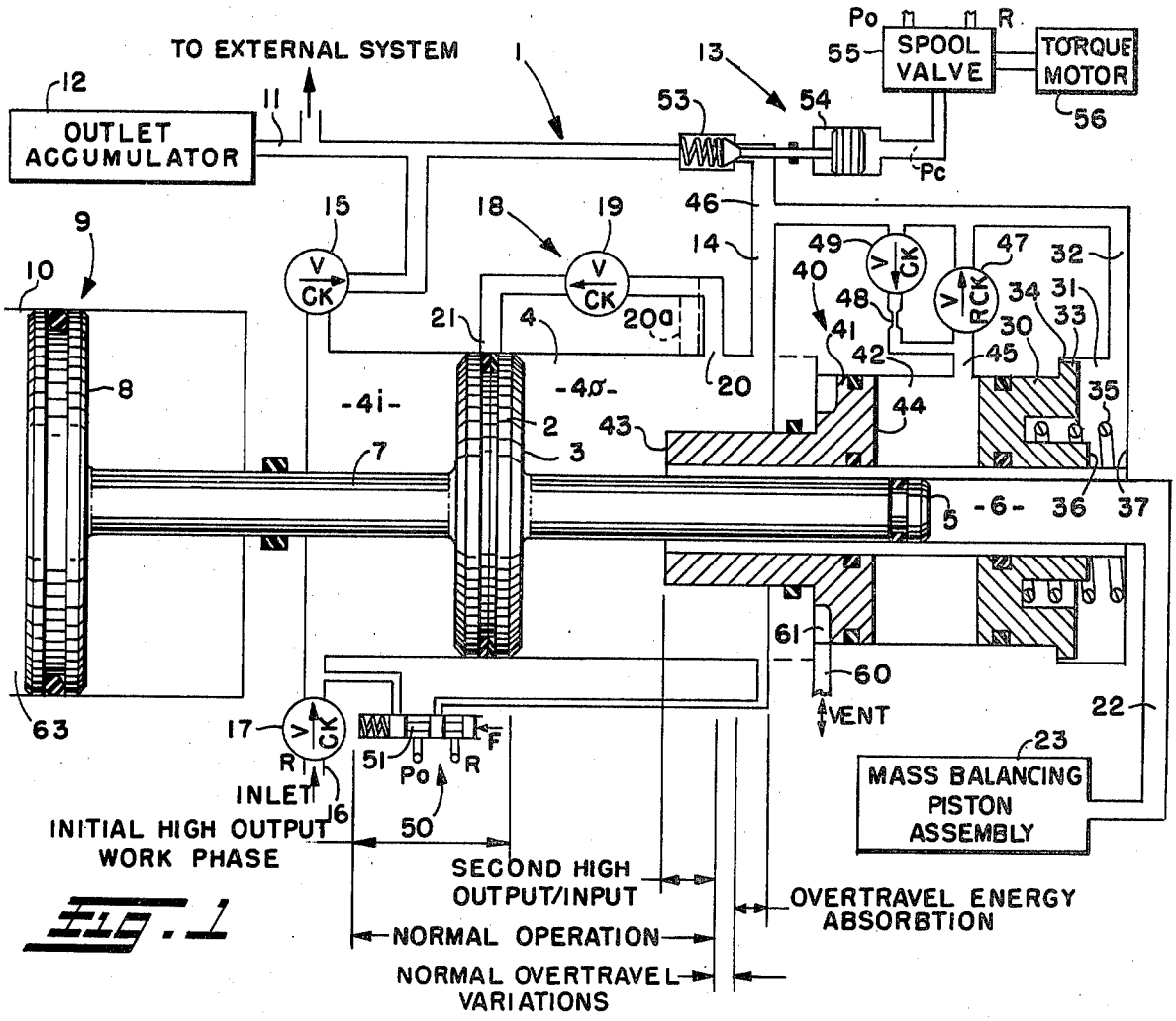
FIG. 1 is a schematic illustration of a free piston engine pump in accordance with the present invention.

Referring now in detail to the drawings, wherein like reference numerals designate like parts in the several figures, and initially to FIG. 1, a free piston engine pump in accordance with the present invention is generally indicated at 1. The pump 1 includes a primary piston 2, which has a large active surface area 3, movable in a primary fluid chamber 4 for pumping fluid at high pressure $P_o$ and a supplemental piston 5 having a relatively smaller surface area movable in a supplemental fluid chamber 6 for pumping fluid at lower pressure $P_A$ for mass balancing purposes. The primary piston 2 is mechanically connected by a rigid piston rod 7 to the engine piston 8 of an internal combustion engine 9, or other prime mover. During the power stroke in response to a gas expansion cycle occurring in the engine piston 8 moves in the engine cylinder 10 driving the primary piston 2 in a righthand direction relative to the illustration of FIG. 1. During the power stroke the pump 1 is operative to pump fluid, preferably hydraulic fluid, through the pump outlet 11 to an external fluid system, not shown, and/or a high pressure fluid accumulator 12. Moreover, during a return or compression stroke, a portion of the stored energy is delivered back to the pump 1 from such external fluid system and/or accumulator 12 via the pump outlet 11 and a cycle valve 13 to move the primary piston 2 and engine piston 8 in the lefthand direction back to an initial position ready for the next power stroke.

The primary chamber 4 is fluidically coupled with the cycle valve 13 and pump outlet 11 via a primary fluid outlet 14. The inlet side 4*i* of the primary pump chamber 4 is connected by an outlet check valve 15 to the pump outlet 11, and a supply of fluid is provided to the inlet side 4*i* via a fluid inlet 16 from a low pressure R fluid reservoir, not shown, and an inlet check valve 17. A single direction fluid transfer flow path 18, which includes a transfer check valve 19 and a pair of fluid transfer ports 20, 21, provides fluid communication between the outlet 4*o* and inlet 4*i* sides of the primary chamber 4 when the primary piston 2 is located between the transfer ports during a power stroke.

A closed fluid path 22 couples the supplemental piston 5 and fluid chamber 6 to a mass balancing piston assembly 23 for desirable mass balancing purposes during the entire power stroke. As will be apparent, the primary piston 2 will not pump fluid through the primary fluid outlet 14 to the pump outlet 11 while it is between the transfer ports 20 and 21. The pump 1, accordingly, provides two levels of output work during a first portion and an intermediate portion of the power stroke, the first level, shown at a in FIG. 2A, being a combination of the high pressure fluid and the low pressure fluid pumped by respective pistons 2 and 5 and the intermediate level, shown at b in FIG. 2A, being only the low pressure fluid pumped by the supplemental piston 5.

Figure 2A:
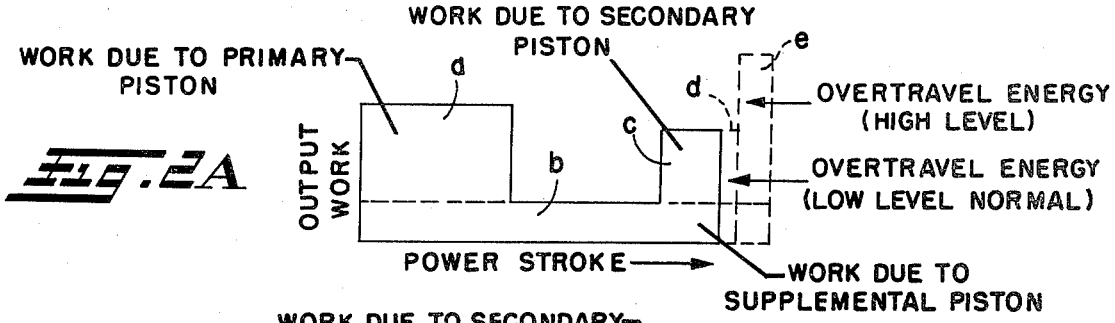
FIGS. 2A and 2B are schematic diagrams of the output work and input work of the power and return strokes for the pump of FIG. 1.

During the latter part of the power stroke a secondary piston 30 is operable to pump fluid from a secondary chamber 31 via a secondary fluid outlet 32, which also is connected to the cycle valve 13, to obtain a second relatively high output work rate at the end of the power stroke, shown at c in FIG. 2A. Initially the secondary piston 30 in the secondary chamber 31 is constrained in its retracted position shown in FIG. 1 by a piston flange 33, which engages a land stop 34, as urged, for example, by a spring 35 and by the differential pressure acting on the outer surface of the secondary piston during the first and intermediate portions of the power stroke. A piston surface 36 on the secondary piston engages a land stop 37 when the secondary piston is urged by fluid pressure to its extreme extended position. During normal operation of the free piston engine pump 1, the secondary piston 30 will be moved to its extreme extended righthand position during the latter portion of each power stroke and will be returned to its initial retracted left-hand position, shown in FIG. 1, during the initial portion of each return stroke to help return the primary piston 2 during the return (compression) stroke by fluid from the external fluid system and/or accumulator 12. The secondary piston 30, accordingly, has a dual function, that is, the providing of a relatively controlled high output work phase at the end of the power stroke as well as a relatively controlled high input work phase at the beginning of a compression stroke, neither of which is dependent on the magnitude, duration, energy, etc. of the power stroke, as long as the secondary piston travels between its extreme extended and retracted positions during each cycle.

A fluid transfer mechanism 40 provides an indirect, i.e. a fluid and not a direct mechanical, connection between the primary piston 2 and the secondary piston 30. The fluid transfer mechanism 40 includes a transfer piston 41 that is movable in a transfer chamber 42 with an inlet surface 43 exposed to fluid pressure in the outlet side 4*o* of the primary chamber 4 and intended to engage mechanically with the primary piston 2, and an outlet surface 44 facing fluid in the transfer chamber 42. A transfer fluid outlet 45 provides single direction flow from the transfer chamber 42 to a common connection 46 with the primary fluid outlet 14, secondary fluid outlet 32, and cycle valve 13 via a relief valve 47 for the purpose of absorbing overtravel energy as the primary piston is driven further to the right at the end of the power stroke after the secondary piston 30 already has bottomed at its maximum position against the land 37. A flow control orifice 48 also provides a controlled flow of fluid, through a check or relief valve 49, if desired, to the transfer chamber 42 from the pump outlet 11 during a compression stroke.

The pump 1 may also include a start valve 50 which is operable prior to first cycle start up of the engine 9 to move the primary piston to its extreme righthand position so that maximum compression is obtained during the first compression stroke just prior to the first power stroke. By applying a force F to a spring loaded spool 51 prior to start up, the high pressure $P_o$ from accumulator 12 acts on the inlet side of primary piston 2 driving it and the secondary and transfer pistons 30, 41 to their extreme righthand positions, while fluid from outlet primary chamber 4*o* is exhausted through start valve 50 to the low pressure reservoir R. The start valve 50 is released when the pistons 2, 30, 41 are in their extreme positions, where they remain until the cycle valve 13 is opened.

For the initial compression stroke, the cycle valve 13 is opened to supply high pressure input fluid $P_o$ from the accumulator 12, for example, to urge the pistons to their extreme lefthand positions to obtain maximum compression and increased temperature in the engine cylinder 10. The cycle valve 13 is a piston activated check valve, including a relief check valve 53 that is opened in response to high pressure fluid pumped by the primary piston through the primary fluid outlet 14 during a power stroke and also in response to selectively applied actuating force from a piston actuator 54 during a compression stroke. Actuation pressure $P_c$ is supplied to the piston actuator 54 for opening the check valve 53 by a spool valve 55 whose movements are controlled by a torque motor 56 in conventional manner in response to externally supplied cycle rate control signals. Movement of the spool valve 55 in the reverse direction connects the piston actuator to return for exhausting the fluid pressure therefrom to permit closing of the check valve.

Figure 2B:
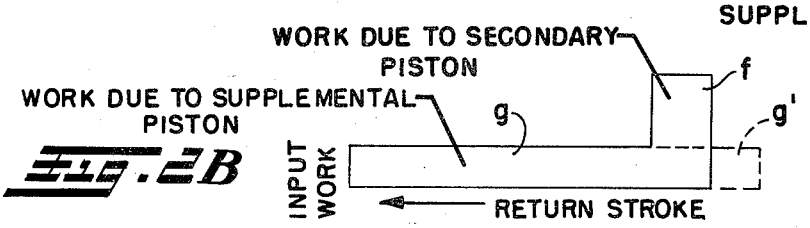

The various boundaries of travel of the primary piston 2 during a power stroke for normal operation of the free piston engine pump 1 and both normal and excessive overtravel variations, while producing an initial high output work phase, intermediate relatively lower output work phase, and second high output work phase at the end of the power stroke are depicted in schematic graphical form in FIG. 1. Moreover, the initial high output work phase, intermediate relatively lower level output work phase, and second high output work phase of the pump 1 are designated, respectively, by areas a, b, c in the graph of FIG. 2A. Areas d and e indicate the output work produced by the pump 1 during normal overtravel and excessive overtravel of the primary piston 2. In FIG. 2B is illustrated the input work delivered to the pump 1 from the external fluid system during the return or compression stroke. The magnitude and duration of the initial high input work rate designated at area f will be consistently the same in each compression stroke as long as the secondary piston has travelled to its extreme outermost extended position during the previous power stroke. The high input work phase will occur at the beginning of each compression stroke so that the duration of the lower input work phase designated by area g following the high input work phase f may be enlarged up to an amount g', depending on the amount of overtravel occurring in the immediately preceding power stroke.

The solid line portions of the two graphs of FIGS. 2A and 2B depict operation of the free piston engine pump 1 to produce output work during a power stroke that does not bring the primary piston 2 into the overtravel region and stored input work required to obtain return of the primary piston during the return or compression stroke. This is the ideal operation and distribution of useful output work and stored input work for the free piston engine pump 1.

Turning now, in addition to FIG. 1, to FIGS. 3A and 3B through 11A and 11B for a more detailed description of the operational modes of the pump 1 during a complete cycle, and initially to FIGS. 3A and 3B, during the first part of the power stroke, a high level of output work is delivered by the free piston engine pump 1. The output volumetric delivery at pressure $P_o$ is based on the area of the large surface area 3. Such output fluid travels via the primary fluid outlet 14, cycle valve 13, and pump outlet 11 to the external fluid system. The piston actuator 54 of the cycle valve 13 is normally ineffective, being connected to return, during the power stroke, but the check valve 53 will open in response to the fluid pressure $P_o$ in the primary fluid outlet 14 to allow fluid to pass to the pump outlet 11 during the initial high output work phase. At the same time, a much lesser amount of output work is transmitted to the mass balancing assembly 23 by the fluid being pumped at a pressure $P_A$ at a volumetric delivery rate based on the small surface area of the supplemental piston 5 established by mass balancing considerations. The output force produced by the pump 1 during such initial high output work phase will be 100% of the maximum output force capability thereof, as is shown in area h of FIG. 3B. To prevent cavitation during this first high output work phase, fluid at a low pressure is admitted into the inlet side 4*i* of the primary chamber 4 through the fluid inlet 16 and inlet check valve 17.

Referring to FIG. 4A, continuing on in the power stroke, the initial high output work phase of the free piston engine pump 1 now terminates and the intermediate relatively low output work phase commences when the surface area 3 of the primary piston 2 passes the inlet transfer port 21. At this time the output volumetric delivery at pressure $P_o$ from the primary fluid outlet 14 terminates and during this intermediate phase, fluid from the outlet side of the primary chamber 4 is transferred at pressure $P_o$ to the inlet side of the primary piston via outlet transfer port 20, transfer check valve 19, and inlet transfer port 21. The lower output force during this intermediate work phase, as designated in FIG. 4B, continues to provide output work in the form of the fluid pumped from the supplemental fluid chamber 6 via the closed fluid path 22 to the mass balancing assembly 23.

The second high output work phase, as illustrated in FIG. 5A, begins when the primary piston 2 contacts input surface 43 of the transfer piston 41, thus also moving the latter in a righthand direction during the remainder of the power stroke. The motion of the transfer piston 41 initially is relayed via fluid in the transfer chamber 42 to move the secondary piston 30 from its initial position of FIG. 1 toward a final position with the surface 36 bottomed against land 37 to pump fluid through the secondary fluid outlet 32, common connection 46, check valve 53, and pump outlet 11 to the external fluid device. During normal operation, the transfer and secondary pistons 41, 30 move together with no fluid passing through the relief valve 47 or orifice 48. Preferably the opposing surface areas of the secondary and transfer pistons 30, 41 facing the transfer chamber 42 are the same size so that the pistons 2, 30, 41 will travel at the same rate during this mode. Since the outlet surface area of the secondary piston 30 is smaller than the surface area 3 of the primary piston 2, the output force and, accordingly, the output work rate of the second high output work phase j in FIG. 5B (and output work area c of FIG. 2A) will be smaller than the respective force and work output during the initial high output phase at the beginning of the power stroke. A vent 60 prevents cavitation and build-up of negative and positive pressure in the area 61 behind the transfer piston. The vent 60 may be coupled to atmospheric pressure, or to a source of low pressure hydraulic fluid, as desired.

During normal operation of the free piston engine pump 1 in a power stroke the secondary piston 30 always will be driven at the latter part of the power stroke to its bottomed final position engaging the land 37. It will be appreciated, then, that the second high output work rate produced by the pump 1 due to the secondary piston 30 at the end of the power stroke is not only independent of precisely timed control valve functions, since it is independent of the cycle valve 13, but also it is independent of the initial high output work rate phase of the power stroke.

Figure 6A:
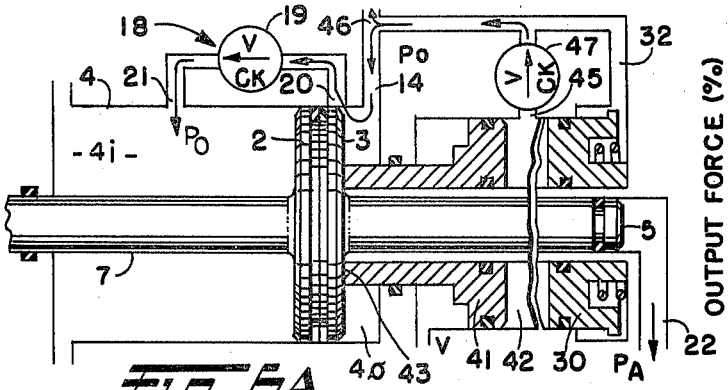

Ideally, for optimum efficiency the power stroke should end when the secondary piston 30 bottoms in its extreme position; however, in practice usually the piston 2 will continue moving into an overtravel region. Normal overtravel operation is illustrated in FIG. 6A. Such normal overtravel of the primary piston 2 causes a corresponding movement of the transfer piston 41 in the righthand direction, which movement can be effectively utilized to pump fluid from the transfer chamber 42 via the relief valve 47 to the pump outlet 11 to obtain additional work output from the pump. The magnitude of the output force and the amount of high level output work produced during such normal overtravel is indicated at area k in FIG. 6B. The primary piston 2 still permits fluid flow via the single direction transfer flow path 18 between ports 20, 21 with a small amount of make-up fluid from that pumped by the transfer piston 41 being received in the outlet side 4*o* of the primary chamber 4 due to surface area reduction of the primary piston 2 caused by mechanical engagement with the transfer piston end surface 43.

Figure 6B:
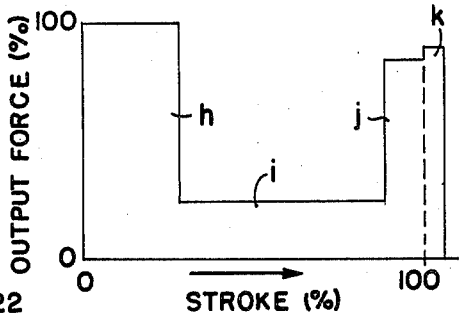

In FIG. 6B the work removed on the power stroke in the limited overtravel region is removed at a relatively low level which is established by the relief valve 47 coupled to the transfer chamber 42, and on return stroke only a small amount of work will have to be added via the flow control orifice 48 to return the transfer piston 41 back to its initial position. Minimizing this added work provides a more constant return stroke and reduces cycle-to-cycle rate variations.

Figure 7A:
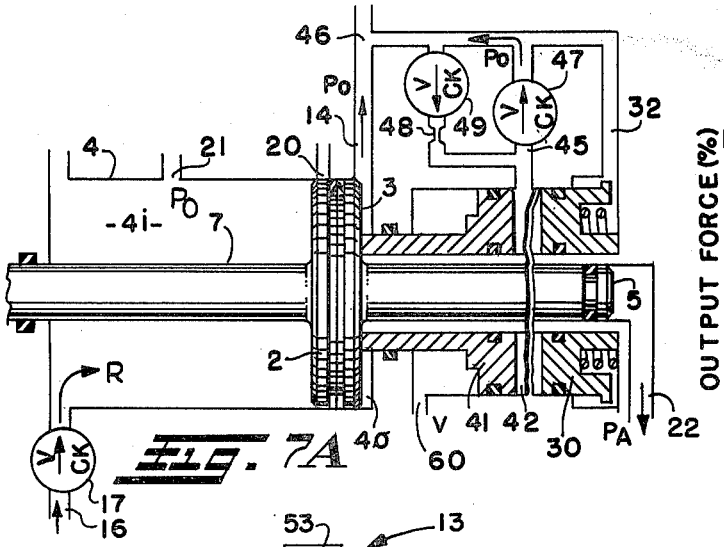
Figure 7B:
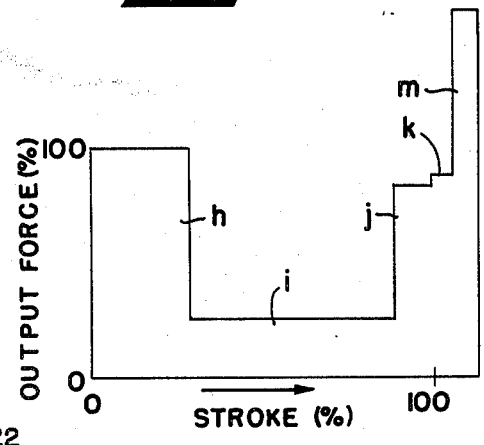

According to the preferred embodiment of the invention, the maximum overtravel encountered by the primary piston 2 ordinarily will not carry the primary piston 2 beyond a location in the primary chamber 4 that would block the outlet transfer port 20. However, as seen in FIGS. 7A and 7B, under an unusual condition caused, for example, by system malfunction or an excessive amount of added energy put into the free piston engine pump 1 by the internal combustion engine 9, a high level of energy may be absorbed to provide structural protection and effectively removed as useful hydraulic work as the primary piston moves further into the overtravel region and blocks the inlet transfer port 20. When this occurs, the pressure on the inlet side 4*i* of the primary chamber 4 drops to inlet pressure, i.e. that provided from the fluid inlet 16, and an additional large amount of output work based on the primary piston 2 and the transfer piston 41 is removed by the pump 1 during such further overtravel movement. The output force and work retained during such energy absorbing high level output work phase by, for example, the external fluid system, is depicted at area m in FIG. 7B. By absorbing a high level of output work during this last phase of the power stroke in the unusually excessive overtravel region of the primary piston 2, the primary piston and, accordingly, engine piston 8 are decelerated relatively rapidly, thereby avoiding damage to the pump 1 and/or the engine 9.

Figure 8A:
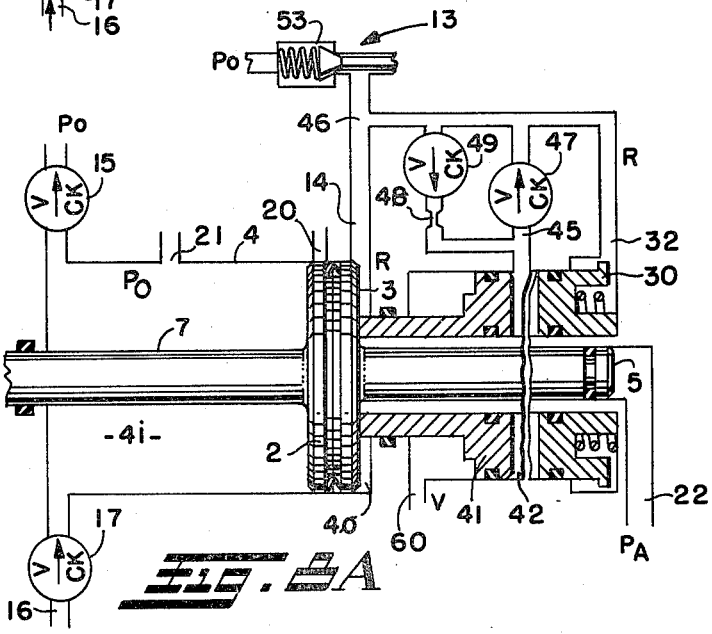
Figure 8B:
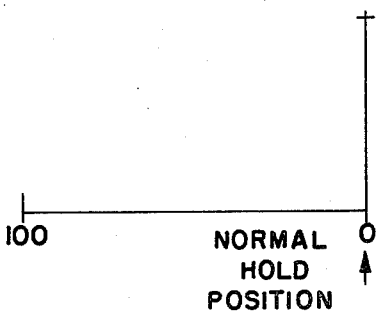

After the primary piston 2 and engine piston 8 have reached their maximum stroke distance at the end of the power stroke, they, and the other components of the pump 1, will be held in a steady state position by the cycle valve 13, as is illustrated, for example, in FIG. 8B, until the piston actuator 54 is actuated to open the check valve portion 53. The check valve portion 53 of the cycle valve 13 prevents back-flow to the pistons in the pump 1, and the primary piston 2 is held in this position, then, until the piston actuator 54 opens the check valve portion 53. During this steady state hold condition or mode of the pump 1, the pressure in the inlet side 4*i* of the primary chamber 4 will increase to an intermediate level $P_i$ due to the mass balancing pressure $P_A$ acting from the mass balancing piston assembly 23 via the closed fluid path 22 on the supplemental piston 5. This pressure $P_i$ is less than the outlet pressure $P_o$ of the external fluid system accumulator. Also, pressure on the outlet side 4*o* of the primary chamber 4 will drop to inlet level R. This unique cycle valve connection and use thereof in a free piston engine pump 1 enables substantially complete control of the period of an engine and pump cycle without further precisely timed control functions.

Figure 9A:
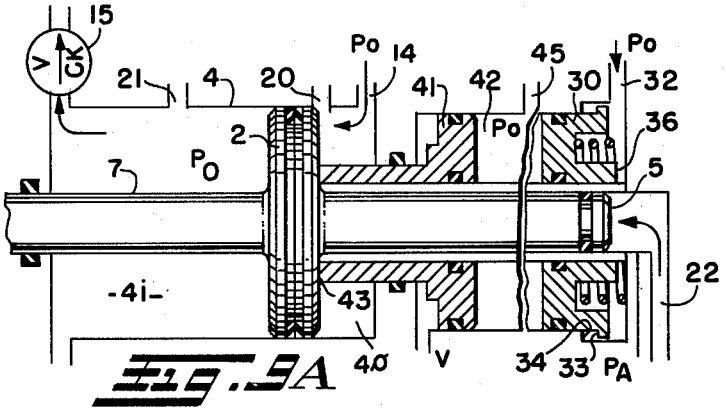
Figure 9B:
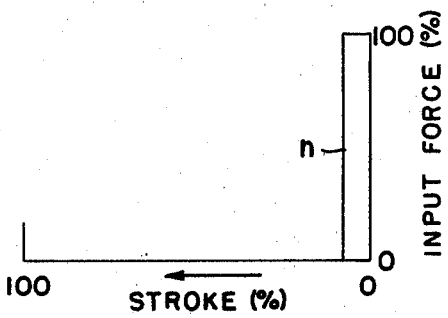

When it is desired to initiate a return cycle, as is illustrated in FIGS. 9A and 9B, the piston actuator 54 is actuated by the spool valve 55 and torque motor 56, or other actuating mechanism, to open the check valve portion 53 of the cycle valve 13 to supply high pressure fluid at a pressure $P_o$ from the external fluid system to the pump pistons.

With the cycle valve 13 open an initial high input work rate, depicted at area n in FIG. 9B, results from the secondary piston force produced by the high fluid pressure acting on surface 36 of the secondary piston 30 and the mass balancing pressure $P_A$ acting on the supplemental piston 5. Such secondary piston force is relayed via fluid in the transfer chamber 42 to the transfer piston 41, which is mechanically abutting the primary piston 2.

Figure 10A:
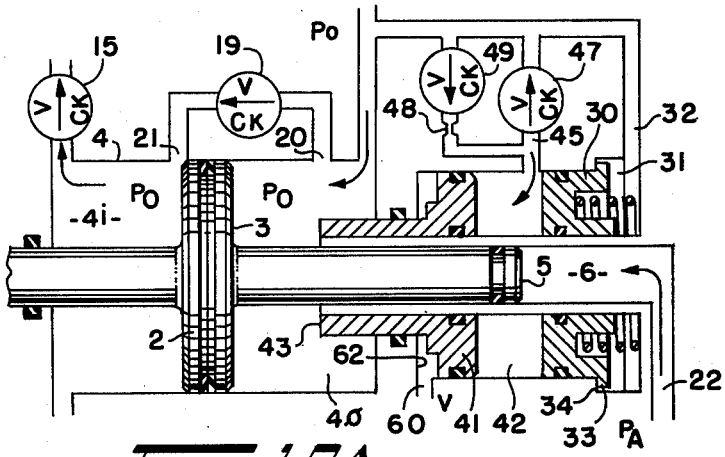

The initial high level work rate, i.e. that occurring at the beginning of the return stroke, ends when the secondary piston 30 bottoms to the left, i.e. the flange 33 abuts the land 34, as is seen in FIG. 10A. Thus, the total duration or stroke length of such initial high input work rate phase is controlled exclusively by the maximum travel of the secondary piston 30 and is entirely independent of any precisely timed control functions and of the magnitudes of the work rates and the total travel of the primary piston and engine piston occurring during the power stroke, as long as in each power stroke the secondary piston is moved to its maximum righthand position bottomed against the land 37. This will be true regardless of the outlet pressure of the fluid delivered at the pump outlet 11 to the external fluid system. The total amount of the initial high input work, depicted at area n' in FIG. 10B, will be subject to the pressure of the fluid delivered to the pump outlet 11 from the external fluid system, which ordinarily will remain constant so that such initial high input work will be the same for each cycle of the free piston engine pump 1.

Figure 10B:
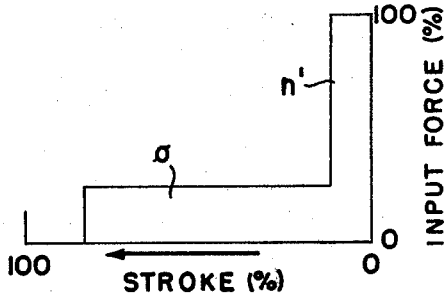

During the remainder of the return stroke after the secondary piston 30 has bottomed against land 34, ending the intial high input work rate phase, the mass balancing pressure acting on the supplemental piston 5 provides sufficient input work, depicted as area o in FIG. 10B, to return the primary piston back to its initial position. Although the outlet side **4*o* of the primary chamber is also exposed to high fluid pressure during such return movement of the primary piston 2, the pressure on opposite sides of the primary piston is effectively balanced, and any excess fluid in the inlet side 4*i* is returned to the outlet accumulator 12 through relief check valve 15** as useful output work.

Following engagement of the secondary piston 30 against land 34, the transfer piston 41 continues to move to its full return position at a much slower rate controlled by the flow control orifice 48. Ordinarily during the time taken by the primary piston 2 to return to its initial position, to change direction of movement, i.e. in the next power stroke, and to contact again the transfer piston 41 at inlet surface 43, the transfer piston will have been fully repositioned to its leftward stop against land 62 by high pressure fluid flowing through the orifice 48 into the transfer chamber 42.

An additional advantage of the arrangement of components in the free piston engine pump 1 is the ability to retain the overtravel energy as useful work. All of the displaced fluid in the overtravel region of the power stroke of both the primary piston 2 and transfer piston 41 is pumped directly to the pump outlet 11 and from there to the outlet high pressure accumulator 23 and/or the external fluid system. Moreover, the work produced by the supplemental piston 5 in the overtravel region is stored in the mass balancing assembly 23 and is used to assist in the return movement of the piston during the return stroke in the manner already described.

Ordinarily to start each cycle of operation of the free piston engine pump 1 and internal combustion engine 9, the cycle valve 13 is opened to move the pistons in a compression stroke. Timing of the retraction of the piston actuator 54 is not critical as long as it is preferably fully retracted to close the check valve portion 53 of the cycle valve 13 by the end of the power stroke to hold the pistons 2, 30, 41 in the hold or steady state mode until the next cycle is initiated. By this cycle control method, the free piston engine pump 1 has a cycle rate control capability that is infinitely adjustable within the design rate of the pump. For example, the rate control can be varied upon demand from well below one cycle per second to the maximum cycle rate of the free piston engine pump 1 and internal combustion engine 9, during which, for example, the cycle valve 13 is continuously held in the open position.

Figure 11A:
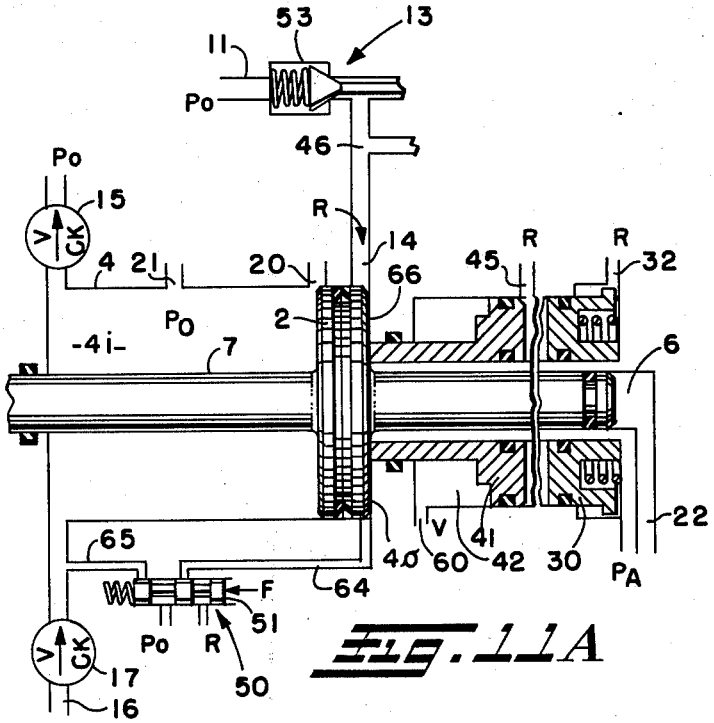
Figure 11B:
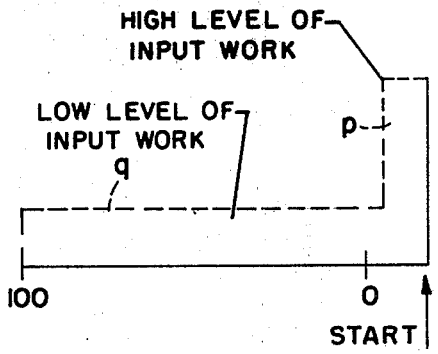

To improve conditions in the engine combustion chamber 63 during the first cycle that the engine and free piston engine pump 1 are starting up, it is desirable to have added compression pressure which will increase the temperature of the compressed air in the engine combustion chamber 63. Prior to the first compression cycle, then, the start valve 50, as seen in FIG. 11A, is operated to move the spool 51 thereof to the left as shown in the drawings, to vent the pressure on the outlet side **4*o* of the primary chamber 4 via flow line 64 and to apply high pressure from the external fluid system to the inlet side 4*i* via flow line 65. The primary piston 2, then, is moved fully to the right against its stop 66 so that maximum compression stroke energy will be applied during the first compression stroke when the start valve 50 is closed and the cycle valve 13 is opened. The normal high level of input work is first put into the system, as depicted at area p in FIG. 11B, followed by a low level of input work, as noted at area q in FIG. 11B, in the same manner that occurred during the high and low input work rate phases described above with references to FIGS. 9A, 9B, 10A and 10B. The high level of input work during this initial compression stroke will be the same as that occurring during a typical return stroke since it is governed by the maximum distance traveled by the secondary piston 30**; however, the total amount of low level input work will have increased since the total travel of the primary piston will be greater than it ordinarily would be during a typical return stroke.

Figure 12:
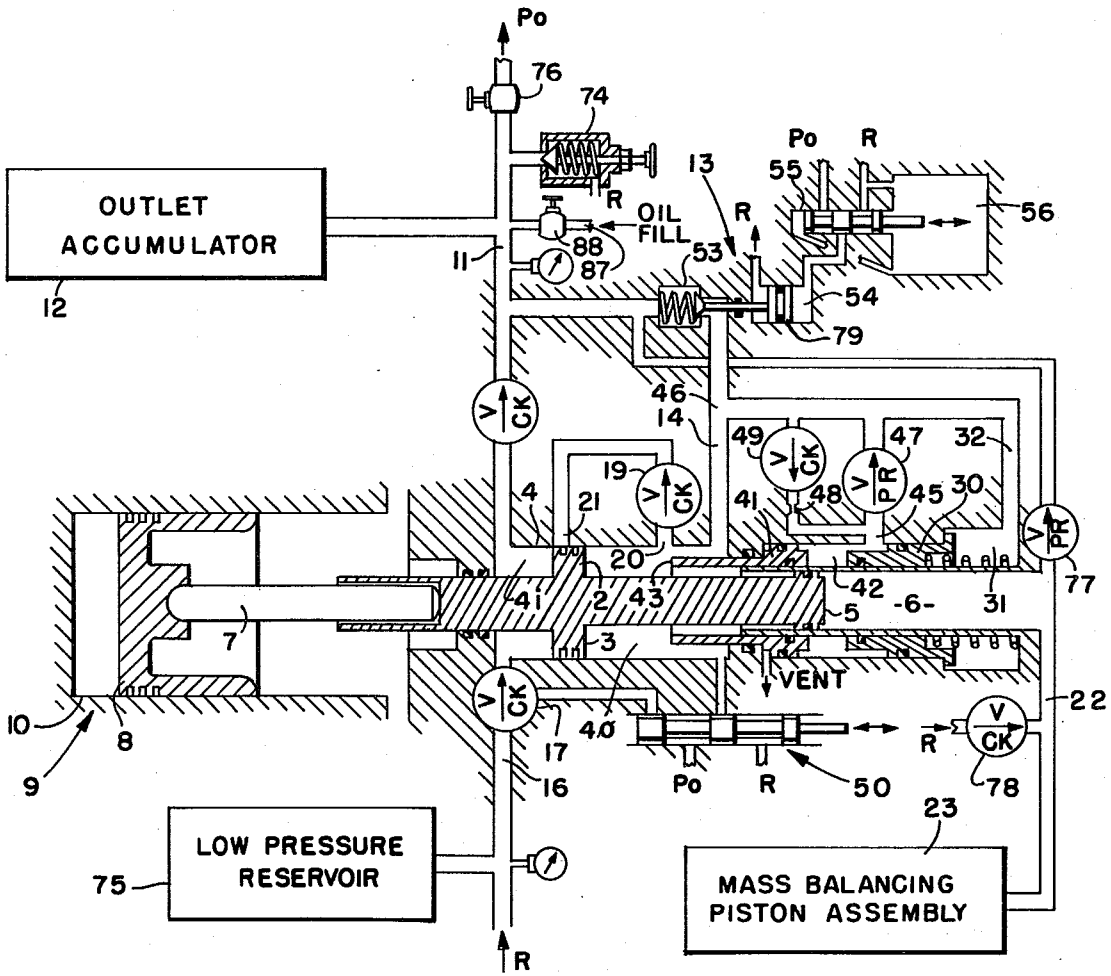
FIG. 12 is a schematic view of a preferred form of free piston engine pump in accordance with the present invention.

A preferred form of free piston engine pump in accordance with the present invention is illustrated in FIG. 12, with the various parts corresponding to those schematically illustrated in FIG. 1 presented in greater detail and labeled with corresponding reference numbers. A pressure relief valve 74 coupled to the pump outlet 11 returns excessive pressure to the external fluid system reservoir 75, and a manually operable shut-off valve 76 is coupled to the pump outlet 11 to close the high pressure fluid path to the external fluid system.

A further pressure relief valve 77 is connected to relieve excessive pressure in the supplemental chamber 6 to the pump outlet 11, and an anti-cavitation inlet check valve 78, which receives fluid from the reservoir 75, for example, is also coupled to the closed fluid path 22 associated with the chamber 6. The torque motor 56 and spool valve 55 which control movement of the piston 79 in the actuator 54 and may control the latter to hold the check valve portion 53 open or closed in the cycle valve 13 also are illustrated in FIG. 12.

Hydraulic fluid may be supplied to the system from an external supply via a line 87 and a manual shut-off valve 88. A number of pressure measuring meters may be connected at various portions of the free piston engine pump 1 to display the fluid pressures occurring therein. The preferred configurations for the primary piston 2, supplemental piston 5, secondary piston 30, and transfer piston 41 also are illustrated in FIG. 12. Preferably the ratios of the surface areas of such pistons are in a ratio of 4:2:3:3; the inlet surface 42 of transfer piston 41 having a relation of 1 to such ratios.

In some instances it may be advantageous to arrange the piston stroke and energy relationships of the free piston engine pump 1 such that the means for absorbing a high level of energy at the end of the power stroke, as described above with reference to FIGS. 7A and 7B, are made to coincide, or even to occur earlier in the power stroke, with operation of the means for absorbing the normal overtravel variations, which are described above with reference to FIGS. 6A and 6B. Such arrangement provides a higher rate of deceleration at the end of the power stroke and thereby confines the normal overstroke travel to a lesser amount than the arrangement described above with reference to FIG. 1, for example. The net effect, assuming the same amount of input energy in either case, is to increase the useful output work and to decrease the non-recoverable work. Moreover, removing a high level of energy at the end of the power stroke provides an abrupt increase in the deceleration when the primary piston enters the overtravel region. The distance traveled into this region, then, is minimized, and the variations in the return stroke energy and cycle rate are minimized, as well.

Figure 13A:
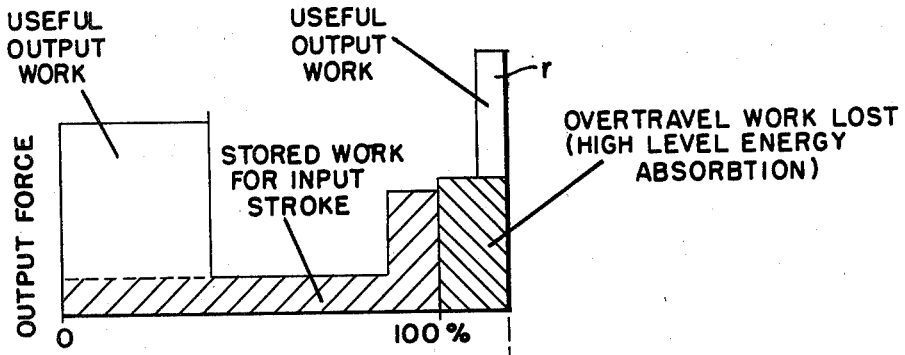
FIGS. 13A and 13B are schematic diagrams of the power and return stroke energy distribution when the free piston engine pump of FIGS. 1 and 12 encounters a high energy excessive overtravel condition during the power stroke.
Figure 13B:
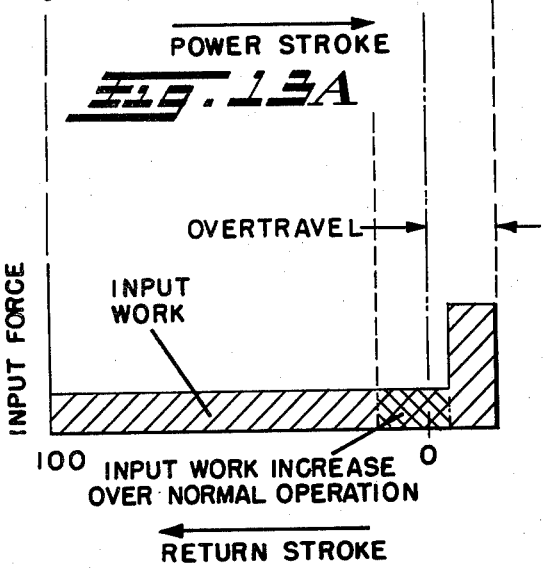

FIGS. 13A and 13B illustrate further the output and input forces occurring in the free piston engine pump 1 during the power and return strokes, including particularly the effect of stroking farther into the overtravel region beyond the normal travel, i.e. beyond the inlet transfer port 20 by the primary piston 2. When the primary piston 2 crosses the outlet transfer port 20, and the inlet side 4*i* of the primary chamber 4 drops to inlet pressure via the check valve 17, an additional high level of output work results, as is depicted at area r in FIG. 13A. The overtravel energy is put into useful work by actually pumping fluid at high pressure and taking in fluid at low pressure. Nevertheless, as further seen in FIG. 13A, a substantial amount of overtravel work is lost, thereby adversely affecting the overall efficiency of the system.

Figure 14:
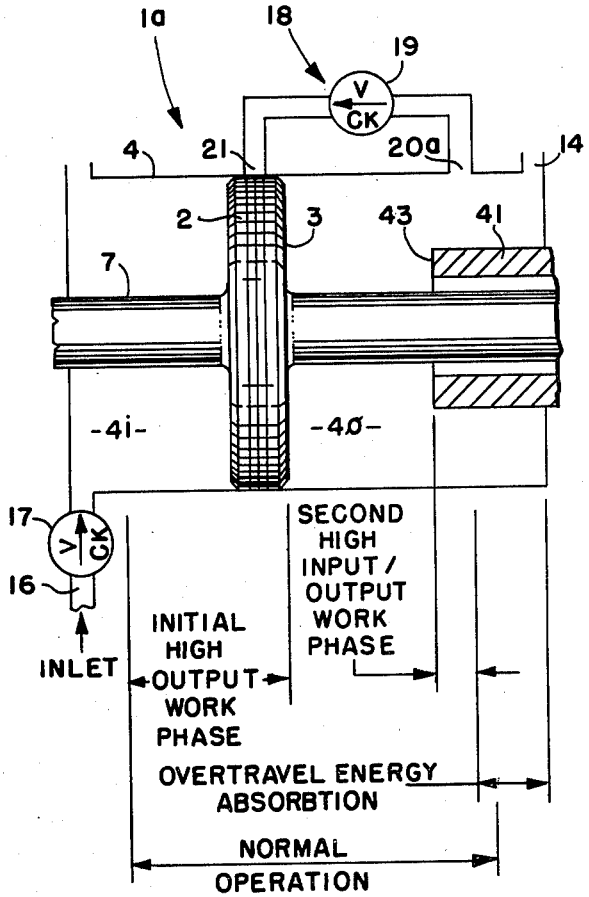
FIG. 14 is a schematic illustration of an alternate free piston engine pump in accordance with the invention in which a larger amount of useful output work is obtained when the pump encounters a high energy overtravel condition than in the embodiments of FIGS. 1 and 12.
Figure 6A:
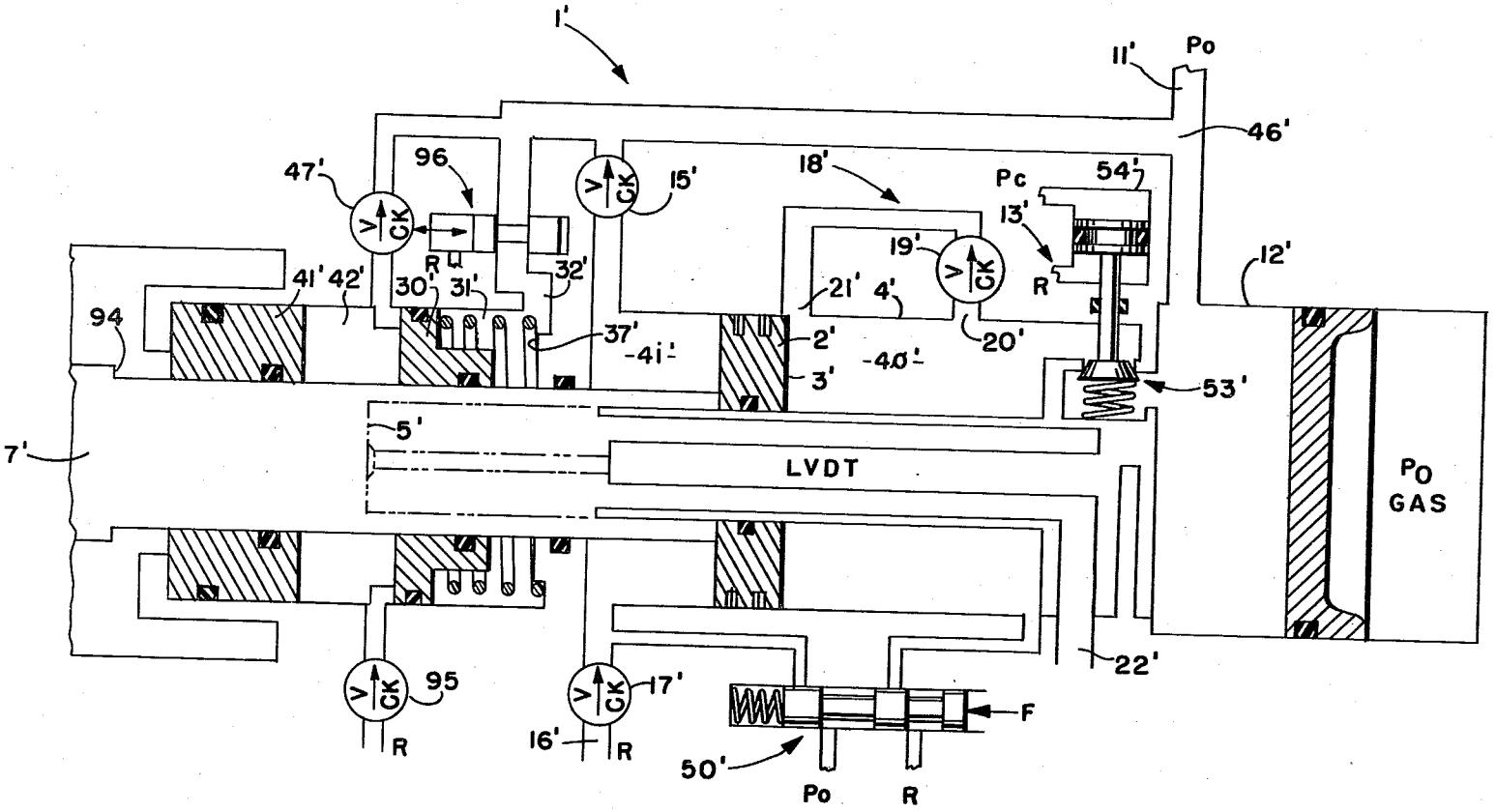

However, if the coincidence noted above were effected in the free piston engine pump, the useful work output obtained in the overtravel region would be enlarged, the amount of work lost in the overtravel region would be reduced, and a more efficient cycle of the pump 1 would ensue. FIG. 14 shows such a modification that may be included in the free piston engine pump 1 described above with reference to FIG. 1 to obtain such coincidence. In particular, in such pump 1*a* the outlet transfer port 20*a* is moved further away from the primary fluid outlet 14 so that the primary piston 2 will block the outlet transfer port 20*a* at the same time that the secondary piston 30 bottoms against its land stop 37, as will also be apparent from the dashed outlet transfer port 20*a* in FIG. 1.

Figure 15:
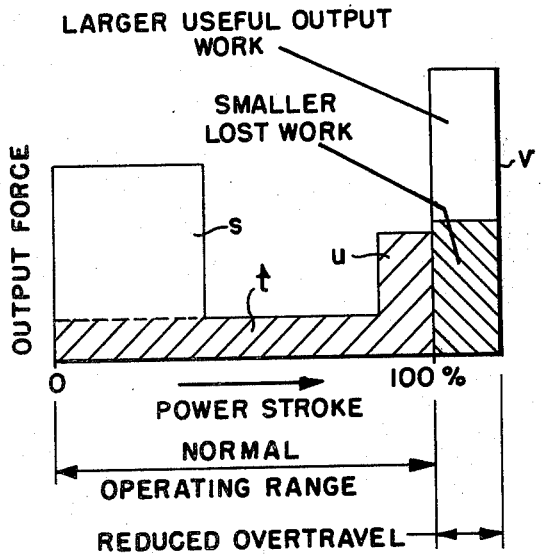
FIG. 15 is a schematic diagram of the power stroke energy distribution occurring when the pump of FIG. 14 encounters a high energy overtravel condition.

Operation of such a modified free piston engine pump 1*a*, then, will provide an initial high output work phase, designated s in FIG. 15, during the first part of the power stroke, followed by a low energy work phase, designated t, during an intermediate portion of the power stroke. At the end of the power stroke there is a high output work phase designated u, as the secondary piston 30 travels, as described above, over its maximum stroke. If the primary piston 2 moves into the overtravel region, blocking the outlet transfer port 20*a*, as soon as the secondary piston 30 has reached land 37, work is removed at the high energy rate because fluid is taken into the inlet side 4*i* of the primary chamber 4 while fluid is pumped at high pressure through the primary fluid outlet 14 and transfer fluid outlet 45, as is seen at designated area v in FIG. 15. Also seen in FIG. 15, the useful work output of the modified pump 1*a* in the overtravel region exceeds that obtained in the pump 1 described above with reference to FIG. 1 and depicted graphically in FIG. 13A, for example, and the work lost is smaller. Another advantage of the pump 1*a* arrangement illustrated in FIG. 14 is that in removing a high level of energy at the beginning of the overtravel stroke, the travel itself is minimized. This has the effect of reducing cycle-to-cycle time variations by providing a more constant stroke length and, therefore, a more constant return energy.

FIG. 16 illustrates a modified form of free piston engine pump 1′ in which primed reference numerals designate parts corresponding to those designated above by unprimed numerals. In this embodiment the transfer piston 41′ is moved by direct engagement with a shoulder 94 of the piston rod 7′ when the piston rod has moved the primary piston 2′ to the end of the intermediate portion of the power stroke, such as that shown at the area b in FIG. 2A. Also, a check valve 95 provides a supply of fluid from the lower pressure fluid reservoir to the transfer chamber 42′, and a transfer relief valve 47′ provides a fluid outlet path from the transfer chamber when the secondary piston 30′ has bottomed against land 37′ at the end of the second high output work phase of the power stroke. The start valve 50′ includes a supplemental start valve portion 96 coupled directly to the secondary chamber 31′ in the secondary fluid outlet 32′. The supplemental start valve portion 96 is operative in parallel with the start valve 50′ to block the connection of the secondary fluid chamber 31′ to the high pressure pump outlet 11′ during starting, while also connecting the secondary fluid chamber 31′ to the low pressure fluid reservoir, thereby enabling the secondary piston 30′ to be moved fully to the right during preparation for the initial compression stroke prior to start-up. The embodiment illustrated in FIG. 16 is otherwise operable in a manner substantially similar to the embodiment described above, for example, with respect to FIG. 1.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A free piston engine pump operative in response to the energy or work rate of a free piston engine, comprising pump means driven by such engine during power strokes of such engine for generating at least one fluid output work rate, said pump means having a pumping chamber and piston means therein; valve means for delivering fluid to said pumping chamber during a return or compression stroke of said piston means to return the same to an initial position ready for the next power stroke; return means operative at a beginning portion of the return or compression stroke for delivering to said pump means to expedite the return stroke a predetermined relatively high input work rate that during a normal operation is independent of the output work rate or rates of the preceding power stroke; said piston means comprising primary piston means for pumping fluid to generate such one fluid output work rate during at least part of the power stroke, and said return means comprising secondary piston means coupled to said primary piston means responsive to a fluid input for delivering such relatively high input work rate to said primary piston means to accelerate the same toward an initial position in preparation for a succeeding power stroke; and transfer means for transferring work between said primary and secondary piston means, mechanical linking means for coupling said primary piston means to the engine, said transfer means comprising transfer piston means for transferring such work, including one area means for directly mechanically engaging said mechanical linking means to transfer forces with respect to the same, and a second area means for transferring forces with respect to said secondary piston means via a fluid.

2. A free piston engine pump operative in response to the energy or work rate of a free piston engine, comprising pump means driven by such engine during power strokes of such engine for generating at least one fluid output work rate, said pump means having a pumping chamber and piston means therein; valve means for delivering fluid to said pumping chamber during a return or compression stroke of said piston means to return the same to an initial position ready for the next power stroke; return means operative at a beginning portion of the return or compression stroke for delivering to said pump means to expedite the return stroke a predetermined relatively high input work rate that during a normal operation is independent of the output work rate or rates of the preceding power stroke; said piston means comprising primary piston means for pumping fluid to generate such one fluid output work rate during at least of the power stroke, and said return means comprising secondary piston means coupled to said primary piston means responsive to a fluid input for delivering such relatively high input work rate to said primary piston means to accelerate the same toward an initial position in preparation for a succeeding power stroke; fluidically responsive transfer means having fluid coupling means between said primary and secondary piston means for transfering work between said primary and secondary piston means; and control orifice means for providing from a source of pressurized fluid a controlled flow of fluid to said transfer means during the return stroke to return said transfer means to an initial position ready for the next power stroke.

3. A free piston engine pump operative in response to the energy or work rate of a free piston engine, comprising pump means driven by such engine during the power stroke for generating plural fluid output work rates, including at least an initial relatively high output work rate and an intermediate relatively low output work rate, secondary pumping means for producing a predetermined independent relatively high output work rate after such intermediate relatively low output work rate, and coupling means for coupling energy from such engine to said secondary pumping means at only a portion of such power stroke after such initial relatively high output work rate near the end of the power stroke to cause said secondary pumping means to produce such relatively high output work rate, independently of the initial relatively high output work rate of said pump means, said pump means comprising a pump outlet, primary piston means for pumping fluid at a relatively high output work rate to said pump outlet during at least part of the power stroke, and said secondary pumping means comprising secondary piston means coupled to said primary piston means movable a predetermined distance at least near the end of the powwer stroke for pumping fluid during such movement, and said pump means further including a transfer flow control means operable during at least an intermediate portion of the power stroke for transferring at least some of the fluid pumped by said primary piston means from reaching said pump outlet and supplemental piston means movable with said primary piston means for pumping fluid during the power stroke at a relatively low output work rate, and said transfer flow control means comprising means for transferring fluid from the outlet side of said primary piston means to the inlet side thereof during an intermediate portion of the power stroke.

4. A free piston engine pump operative in response to the energy or work rate of a free piston engine, comprising pump means driven by such engine during the power stroke for generating plural fluid output work rates including at least an initial relatively high fluid output work rate; secondary pumping means for producing a predetermined relatively high output work rate at least near the end of the power stroke; means for coupling energy from such engine to said secondary pumping means via said pump means at only a portion of such power stroke near the end of the power stroke to cause said secondary pumping means to produce such relatively high output work rate independently of such initial relatively high fluid output work rate of said pump means; a fluid outlet; said pump means comprising a cylinder, supply means for supplying fluid to said cylinder, and primary piston means movable in said cylinder in response to energy produced by such engine during a power stroke for pumping fluid to said fluid outlet during one part of the power stroke; and said secondary pumping means comprising a secondary cylinder, secondary piston means movable in said secondary cylinder, and boundary means for limiting movement of said secondary piston means in said secondary cylinder to a predetermined distance between initial and extreme positions.

5. The pump of claim 4, said pump means further comprising a supplemental cylinder, a supplemental piston means for pumping fluid in said supplemental cylinder during at least substantially the entire power stroke, and a transfer flow control means operable during at least an intermediate portion of the power stroke for transferring at least some of the fluid pumped by said primary piston means from reaching said pump outlet, thereby reducing the effective fluid output work rate of said pump means during such intermediate portion of the power stroke.

6. A free piston engine pump operative in response to the energy or work rate of a free piston engine, comprising pump means driven by such engine during power strokes of such engine for generating at least one fluid output work rate, said pump means having a pumping chamber and piston means therein, valve means for delivering fluid to said pumping chamber during a return or compression stroke of said piston means to return the same to an initial position ready for the next power stroke, and return means operative at a beginning portion of the return or compression stroke for delivering to said pump means to expedite the return stroke a predetermined relatively high input work rate that during a normal operation is independent of the output work rate or rates of the preceding power stroke, said piston means comprising primary piston means for pumping fluid to generate such one fluid output work rate during at least part of the power stroke, and said return means comprising secondary piston means coupled to said primary piston means responsive to a fluid input for delivering such relatively high input work rate to said primary piston means to accelerate the same toward an initial position in preparation for a succeeding power stroke, said pump further comprising a chamber, said secondary piston means being positioned in said chamber and movable a predetermined distance with respect to the latter during a beginning portion of the return stroke to deliver such high input work rate to said pump means exclusively while moving over such predetermined distance.

7. The pump of claim 6, further comprising means for normally moving said secondary piston means such predetermined distance at least near the end of the power stroke to cause the latter to produce a relatively high output work rate.

8. A free piston engine pump operative in response to the energy or work rate of a free piston engine, comprising pump means driven by such engine during power strokes of such engine for generating at least one fluid output work rate, said pump means having a pumping chamber and piston means therein; valve means for delivering fluid to said pumping chamber during a return or compression stroke of said piston means to return the same to an initial position ready for the next power stroke; return means operative at a beginning portion of the return or compression stroke for delivering to said pump means to expedite the return stroke a predetermined relatively high input work rate that during a normal operation is independent of the output work rate or rates of the preceding power stroke; said piston means comprising primary piston means for pumping fluid to generate such one fluid output work rate during at least part of the power stroke, and said return means comprising secondary piston means coupled to said primary piston means responsive to a fluid input for delivering such relatively high input work rate to said primary piston means to accelerate the same toward an initial position in preparation for a succeeding power stroke; and transfer means for transferring work between said primary and secondary piston means, said transfer means comprising transfer piston means for transferring such work, including a first means for directing mechanically transferring forces with respect to said primary piston means and a second means for transferring forces with respect to said secondary piston means via a fluid.

9. The pump of claim 8, said first means and said second means comprising respective surfaces of said transfer piston means, further comprising energy absorbing means for absorbing excessive energy from said pump means during overtravel thereof in the power stroke, including flow relief means for permitting controlled outflow from between said transfer and secondary piston means when the latter has moved to its extreme position during the power stroke and said primary piston means continues to move said transfer piston means.

10. The pump of claim 8, said pump means further comprising supplemental piston means coupled to said primary piston means responsive to the energy or work rate of such engine for pumping fluid at a substantially constant output work during the power stroke.

11. A free piston engine pump operative in response to the energy or work rate of a free piston engine, comprising pump means driven by such engine during the power stroke for generating plural fluid work rates, said pump means including primary piston means movable during the power stroke over a normal predetermined stroke distance and capable of movement into an overtravel region in response to excess engine energy, outlet means for delivering fluid pumped by said primary piston means during at least part of such predetermined stroke distance, start means for moving said piston means substantially fully into such overtravel region prior to start up the pump and engine, and return means for returning said primary piston means fully from such overtravel region and at least substantially completely over such normal predetermined stroke distance to obtain substantially maximum compression in the engine prior to an initial power stroke at start-up thereof, said return means including means operative at the beginning of a return or compression stroke for delivering a predetermined relatively high input work rate to said pump means, including secondary piston means coupled to said primary piston means for delivering such high input work rate and means for limiting the travel distance of said secondary piston means enabling the latter to expedite the return stroke independently of the output work rate or rates of the preceding power stroke, and said start means including means for moving said secondary piston means to its extreme position thereby to obtain such expedited return of said primary piston means.

12. The pump of claim 11, said start means comprising valve means for delivering high pressure fluid to said primary piston means to move the same.

13. The pump of claim 12, said start means further comprising supplemental valve means for effecting a pressure difference across said secondary piston means permitting movement of the same to such extreme position.

14. A free piston engine pump operative in response to the energy of work rate of a free piston engine, comprising pump means driven by such engine during the power stroke for generating plural fluid output work rates, including at least an initial relatively high output work rate and an intermediate relatively low output work rate; secondary pumping means for producing a predetermined independent relatively high output work rate after such intermediate relatively low output work rate; coupling means for coupling energy from such engine to said secondary pumping means at only a portion of such power stroke after such initial relatively high output work rate near the end of the power stroke to cause said secondary pumping means to produce such relatively high output work rate independently of the initial relatively high output work rate of said pump means; said pump means comprising a pump outlet, primary piston means for pumping fluid at a relatively high output work rate to said pump outlet during at least part of the power stroke, and said secondary pumping means comprising secondary piston means coupled to said primary piston means movable a predetermined distance at least near the end of the power stroke for pumping fluid during such movement; energy absorbing means for absorbing overtravel work produced by said pump means at the end of the power stroke; and transfer means for transferring work between said primary and secondary piston means, including flow relief means for permitting controlled outflow of fluid from between said transfer means and secondary piston means when the latter has moved to its extreme position during the power stroke and said primary piston means continues to move said transfer means in an overtravel mode.

15. The pump of claim 14, said transfer means comprising transfer piston means for transferring such work, including first means for directly mechanically transferring forces with respect to said primary piston means and second means for transferring forces with respect to said secondary piston means via a fluid.

16. The pump of claim 14, said pump means including a transfer flow control means operable during at least an intermediate portion of the power stroke for tranferring at least some of the fluid pumped by said primary piston means from reaching said pump outlet.

17. The pump of claim 16, said pump means further comprising primary fluid chamber means for containing said primary piston means with the latter being movable in the former, and said transfer flow control means comprising an inlet transfer port means for conducting fluid out of the outlet side of said primary chamber means thereby diverting such fluid from said pump outlet, said inlet transfer port means being positioned so as to permit flow of fluid therethrough as pumped by said primary piston means during at least part of the power stroke after said secondary piston means has been moved to the extreme of such predetermined distance during the power stroke.

18. The pump of claim 16, said pump means further comprising primary fluid chamber means for containing said primary piston means with the latter being movable in the former, and said transfer flow control means comprising an inlet transfer port means for conducting fluid out of the outlet side of said primary chamber means thereby diverting such fluid from said pump outlet, said inlet transfer port means being positioned so as to permit flow of fluid therethrough as pumped by said primary piston means during at least part of the power stroke until said secondary piston means has been moved to the extreme of such predetermined distance during the power stroke and thereafter to be blocked to prevent further flow therethrough during the remainder of the power stroke.

19. The pump of claim 18, said transfer means comprising transfer piston means for transferring such work, including a first means for directly mechanically transferring forces with respect to said primary piston means and a second means for transferring forces with respect to said secondary piston means via a fluid.

20. A free piston engine pump operative in response to the energy or work rate of a free piston engine, comprising pump means driven by such engine during the power stroke for generating plural fluid output work rates, including at least an initial relatively high output work rate and an intermediate relatively low output work rate, secondary pumping means for producing a predetermined independent relatively high output work rate after such intermediate relatively low output work rate, and coupling means for coupling energy from such engine to said secondary pumping means at only a portion of such power stroke after such initial relatively high output work rate near the end of the power stroke to cause said secondary pumping means to produce such relatively high output work rate independently of the initial relatively high output work rate of said pump means, said pump means comprising a pump outlet and primary piston means for pumping fluid at a relatively high output work rate to said pump outlet during at least part of the power stroke, and said secondary pumping means comprising secondary piston means coupled to said primary piston means movable a predetermined distance at least near the end of the power stroke for pumping fluid during such movement.

21. The pump of claim 20, said pump means further including a transfer flow control means operable during at least an intermediate portion of the power stroke for transferring at least some of the fluid pumped by said primary piston means from reaching said pump outlet.

22. The pump of claim 20, further comprising transfer means for transferring work between said primary and secondary piston means.

23. The pump of claim 20, further comprising cycle control means for holding said pump means and return means in relatively fixed positions at the conclusion of the power stroke, said cycle control means including means for selectively supplying input fluid to the pump to effect the return stroke.

24. The pump of claim 20, further comprising start means for operating said pump means and secondary pumping means substantially fully to their extreme positions in the direction of movement encountered during a power stroke prior to start-up of the pump and engine, and means for returning said pump means and secondary pumping means fully from such extreme positions in an initial return stroke prior to start-up of the pump and engine to obtain substantially maximum compression in the engine prior to an initial power stroke at start-up thereof.

25. The pump of claim 20, said pump means being coupled to said engine, and further comprising return means including said secondary piston means operative at the begining of a return or compression stroke for delivering a predetermined independent relatively high input work rate to said pump means to cause the latter to effect such compression stroke in the engine.

26. The pump of claim 20, further comprising energy absorbing means for absorbing overtravel work produced by said pump means at the end of the power stroke.

27. The pump of claim 20, said pump means further comprising supplemental piston means movable with said primary piston means for pumping fluid during the power stroke at a relatively low output work rate.

28. The pump of claim 27, further comprising mass balancing piston means for receiving fluid pumped by said supplemental piston means and for applying input work to the latter during the return stroke.

29. A free piston engine pump operative in response to the energy or work rate of a free piston engine, comprising pump means driven by such engine during the power stroke for generating fluid output work at least including an initial relatively high fluid output work rate, secondary pumping means for producing a predetermined relatively high output work rate at least near the end of the power stroke, means for coupling energy from such engine to said secondary pumping means at only a portion of such power stroke near the end of the power stroke to cause said secondary pumping means to produce such relatively high output work rate independently of such initial relatively high fluid output work rate of said pump means, and a fluid outlet, said pump means comprising a cylinder, supply means for supplying fluid to said cylinder, primary piston means movable in said cylinder in response to energy produced by such engine during a power stroke for pumping fluid to said fluid outlet during one part of the power stroke, and said secondary pumping means comprising a secondary cylinder, secondary piston means movable in said secondary cylinder, and boundary means for limiting movement of said secondary piston means in said secondary cylinder to a predetermined distance between initial and extreme positions.

30. The pump of claim 29, said means for coupling comprising transfer means for transferring work from said primary piston means to said secondary piston means after said primary piston means has travelled a predetermined distance in said cylinder during a power stroke, at least a portion of said transfer piston means being movable in said secondary cylinder, a transfer chamber in said secondary cylinder between said portion of said transfer piston means and said secondary piston means, and fluid means in said transfer chamber for coupling work between said transfer piston means and said secondary piston means, and further comprising transfer flow control means operable during a portion of such power stroke after said primary piston means has delivered fluid to said fluid outlet at a relatively high output work rate for transferring at least some of the fluid pumped by said primary piston means during such portion of such power stroke from reaching said fluid outlet.

31. The pump of claim 29, further comprising a free piston engine including a movable engine piston means for applying work to said pump means during a power stroke and for receiving work from said pump means during a compression stroke.

32. The pump of claim 29, said means for coupling comprising means for mechanically engaging said primary piston means after the latter has travelled a predetermined distance in said cylinder during a power stroke.

33. The pump of claim 32, said means for mechanically engaging comprising a transfer piston having at least one portion movable in said cylinder and at least a second portion movable in said secondary cylinder, a transfer chamber in said secondary cylinder between said transfer piston and said secondary piston means, and fluid means in said transfer chamber for coupling work between said transfer piston and said secondary piston means.

34. The pump of claim 33, further comprising a relief check valve means for coupling fluid from said transfer chamber to said fluid outlet during a power stroke after said secondary piston means has been moved to its extreme limit in response to the energy of such engine.

35. The pump of claim 33, further comprising means for supplying fluid pressure to said secondary piston means in a compression stroke to move the same in said secondary cylinder to apply work to said primary piston means through said transfer piston thereby to expedite acceleration of said primary piston means at the beginning of the compression stroke.

36. The pump of claim 35, further comprising a relief check valve means for coupling fluid from said transfer chamber to said fluid outlet during a power stroke after said secondary piston means has been moved to its extreme limit in response to the energy of such engine.

37. The pump of claim 36, further comprising controlled flow means for delivering fluid to said transfer chamber at a controlled rate to return said transfer piston to an initial position in said secondary cylinder after said secondary piston means has been moved to an initial position and prior to the next power stroke.

38. The pump of claim 37, further comprising means for normally urging said secondary piston means to such initial position in said secondary cylinder.

39. A free piston engine pump operative in response to the energy or work rate of a free piston engine, comprising pump means driven by such engine during power strokes of such engine for generating at least one fluid output work rate, said pump means having a pumping chamber and piston means therein, valve means for delivering fluid to said pumping chamber during a return or compression stroke of said piston means to return the same to an initial position ready for the next power stroke, and return means operative at a beginning portion of the return or compression stroke for delivering to said pump means to expedite the return stroke a predetermined relatively high input work rate that during a normal operation is independent of the output work rate or rates of the preceding power stroke, said return means comprising secondary piston means coupled to said piston means movable in a chamber a predetermined distance during a beginning portion of the return stroke for delivering such high input work rate to said piston means exclusively while moving over such predetermined distance.

40. The pump of claim 39, further comprising energy absorbing means for absorbing energy from said pump means during overtravel thereof in the power stroke.

41. The pump of claim 39, further comprising start means for operating said pump means and return means substantially fully to their extreme positions in the direction of movement encountered during a power stroke prior to start-up of the pump and engine, and means for returning said pump means and return means fully from such extreme positions in an initial return stroke prior to start-up of the pump and engine to obtain substantially maximum compression in the engine prior to an initial power stroke at start-up thereof.

42. The pump of claim 39, wherein said pump means generates plural fluid output work rates including at least an initial relatively high fluid output work rate, and secondary pumping means are provided for producing a predetermined relatively high output work rate at least near the end of the power stroke, and means for coupling energy from such engine to said secondary pumping means via said pump means at only a portion of such power stroke near the end of the power stroke to cause said secondary pumping means to produce such relatively high output work rate independently of such initial relatively high fluid output work rate of said pump means.

43. The pump of claim 39, said piston means including primary piston means movable during the power stroke over a normal predetermined stroke distance and capable of movement into an overtravel region in response to excess engine energy, outlet means for delivering fluid pumped by said primary piston means during at least part of such predetermined stroke distance, and start means for moving said primary piston means substantially fully into such overtravel region prior to start-up of the pump and engine, said return means being operative to return said primary piston means fully from such overtravel region and at least substantially completely over such normal predetermined stroke distance to obtain substantially maximum compression in the engine prior to an initial power stroke at start-up thereof.

44. The pump of claim 39, further comprising means coupling said piston means to said secondary piston means for normally moving said secondary piston means such predetermined distance at least near the end of the power stroke to cause the latter to produce a relatively high output work rate.

45. The pump of claim 44, said piston means comprising primary piston means for producing at least one initial relatively high fluid output work rate at least near the beginning of the power stroke and at least one relatively low fluid output work rate at an intermediate portion of the power stroke, said pump means further comprising fluid outlet means for delivering fluid to do work and output means for conducting fluid from said primary piston means and from said secondary piston means to said fluid outlet means sequentially to provide as work outputs from the pump such initial relatively high output work rate, intermediate relatively low output work rate, and such relatively high output work rate produced by said secondary piston means.

46. The pump of claim 39, said piston means comprising primary piston means for pumping fluid to generate such one fluid output work rate during at least part of the power stroke, said secondary piston means being coupled to said primary piston means responsive to a fluid input for delivering such relatively high input work rate to said primary piston means to accelerate the same toward an initial position in preparation for a succeeding power stroke.

47. The pump of claim 46, further comprising transfer means for transferring work between said primary and secondary piston means.

48. The pump of claim 39, further comprising cycle control means for holding said pump means and return means in relatively fixed positions at the conclusion of the power stroke, said cycle control means including means for selectively effecting the supply of input fluid to the pump to effect the return stroke.

49. The pump of claim 48, said valve means comprising check valve means for passing output fluid pumped by the pump during the power stroke, and said means for selectively supplying comprising actuator means for opening said check valve means during the return stroke to pass input fluid to said return means to obtain such high input work rate at the beginning of the return stroke.

50. The pump of claim 39, further including outlet means for delivering fluid from said pump means as it is pumped during at least part of the power stroke, said piston means comprising primary piston means for pumping fluid to said outlet means during only part of the power stroke and supplemental piston means for pumping fluid during the entire power stroke, and cycle control means for controlling the frequency of cycles of the pump, each cycle including a power and return stroke, said cycle control means including said valve means for permitting flow of fluid pumped by said piston means to said outlet means and for normally blocking flow of fluid from said outlet means to said piston means at the end of the power stroke, and actuator means for selectively opening said valve means to permit flow of fluid to said piston means during the return stroke.

51. The pump of claim 50, further comprising secondary means coupled to said piston means movable in response to movement of said primary piston means at least near the end of the power stroke for producing a predetermined relatively high output work rate at least near the end of the power stroke.

52. The pump of claim 50, said primary piston means and supplemental piston means including means driven by such engine during the power stroke for generating plural fluid output work rates, including at least an initial relatively high output work rate and an intermediate relatively low output work rate, and further comprising secondary means for producing a predetermined relatively high output work rate after such intermediate relatively low output work rate, and means for coupling energy from such engine to said secondary pumping means at only a portion of such power stroke near the end of the power stroke to cause said secondary pumping means to produce such relatively high output work rate independently of the output work rate of said pump means.

53. The pump of claim 50, said valve means comprising a check valve, and said actuator means comprising a fluid actuator for selectively opening said check valve to permit the flow of fluid from said outlet means to said piston means to return the latter to position ready for a subsequent power stroke.

* * * * *